US007342227B1

(12) United States Patent
Blair et al.

(10) Patent No.: US 7,342,227 B1
(45) Date of Patent: Mar. 11, 2008

(54) COATING FOR THE BREAKDOWN OF CORONA EFFLUENTS

(75) Inventors: Christopher D. Blair, Webster, NY (US); Joy L. Longhenry, Webster, NY (US); Jeffry Welch, Morrison, CO (US); Thomas Debies, Webster, NY (US); Bruce J. Parks, Bloomfield, NY (US); Eliud Robles-Flores, Webster, NY (US); Evan Kastner, Rochester, NY (US); Jamie S. Clayfield, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 192 days.

(21) Appl. No.: 11/409,665

(22) Filed: Apr. 24, 2006

(51) Int. Cl.
*H01T 19/00* (2006.01)

(52) U.S. Cl. ..... 250/324; 250/326; 252/500; 252/518.1; 355/221; 361/230; 430/937

(58) Field of Classification Search ..... 250/324, 250/326; 252/500, 518.1, 519.1; 355/221, 355/225; 361/225, 230; 430/937
See application file for complete search history.

(56) References Cited

U.S. PATENT DOCUMENTS 5,153,618 A * 10/1992 Frank et al. ..... 347/125
5,510,879 A * 4/1996 Facci et al. ..... 399/168
5,539,205 A * 7/1996 Reale ..... 250/326
7,264,752 B2 * 9/2007 Drappel ..... 252/500

OTHER PUBLICATIONS

"Plasma-sprayed Coatings", Scientific American Sep. 1988.
Environmental Health Perspectives, vol. 109, No. 4, Apr. 2001.
"Reactive oxygen species inhibited by titanium oxide coatings", Sep. 2002.

* cited by examiner

*Primary Examiner*—Kiet T. Nguyen
(74) *Attorney, Agent, or Firm*—James J. Ralabate

(57) ABSTRACT

A plasma sprayed $TiO_2$ coating is used to remove effluents produced during an electrical charging step using a corona charging device. The plasma spray allows for the application of $TiO_2$ ceramic to an aluminum dicorotron housing. Plasma spray also increases the electrical conductivity of the $TiO_2$ (which is necessary for the dicorotron operation). Plasma sprayed coatings are also porous which aids in the capture and reduction of effluents.

20 Claims, 3 Drawing Sheets

COATING FOR THE BREAKDOWN OF CORONA EFFLUENTS

This invention relates to electrostatic marking systems and more specifically to the corona charging components of these systems.

BACKGROUND

In an electrostatographic process, a system is used whereby a uniform electrostatic charge is placed upon a reusable photoconductive surface. The charged photoconductive surface is then exposed to a light image of an original to selectively dissipate the charge to form a latent electrostatic image of the original on the photoreceptor. The latent image is developed by depositing finely divided marking and charged particles (toner) upon the photoreceptor surface. The charged toner is electrostatically attached to the latent electrostatic image areas to create a visible replica of the original. The toned developed image is then transferred from the photoconductor surface to a final image support material, such as paper, and the toner image is fixed thereto by heat and pressure to form a permanent copy corresponding to the original.

In Xerographic systems of this type, a photoreceptor surface is generally arranged to move in an endless path through the various processing stations of the Xerographic process. The photoconductive or photoreceptor surface is generally reusable whereby the toner image is transferred to the final support material, and the surface of the photoreceptor is prepared to be used once again for another reproduction of an original. In this endless path, several stations of corona charging are traversed. These charging stations may involve one or a cluster of dicorotron or other corotron units.

Several methods are known for applying an electrostatic charge to the photosensitive member such as the use of electron-emitting pins, an electron-emitting grid, single corona-charging structures and single or multiple dicorotron wire assemblies. In recent development of high speed Xerographic reproduction machines where copiers can produce at a rate of or in excess of three thousand copies per hour, the need for several reliable dicorotron wire assemblies and good final copies are required.

Usually, in electrostatographic or electrostatic copy processes, as those above noted, a number of corotrons or dicorotrons are used at various stations around the photoreceptor. For example, the dicorotrons are used at the station that places a uniform charge on the photoreceptor, at a transfer station, at a cleaning station, etc. In today's high speed copiers, it is important that all corotrons (or dicorotrons) are somewhat controlled regarding effluents given off in the charging process. Generally, the structure of a dicorotron uses a thin, glass-coated wire mounted in an elongated U-shaped housing between two insulating anchors called "insulators". These support the wire in the U-shaped housing in a spring-tensioned manner in a singular plane. This dicorotron unit or assembly, usually an aluminum, comprises housing, as above noted, is in one embodiment an elongated U-shaped shield. The wire or corona-generating electrode is typically a highly conductive, elongated wire situated in close proximity to the photoconductive surface to be charged.

As earlier noted, the charging of the photoreceptor is necessary for the proper operation of the Xerographic machine. A by-product of corona charging devices are several gasses (most notably $NO_x$ and ozone) which are referred to in this discussion as "effluents". The effluents can interact with the surrounding atmosphere, which may include organic compounds like morpholine, and with the photoreceptor itself to produce substantial negative effects on the photoreceptor and the resulting copy. These are sometimes called lateral charge migration (LCM) and/or parking deletion. This can cause the output of a printed copy to appear blurry or have areas where the image is entirely missing (deleted). Currently, fans and special coatings are utilized to remove or neutralize the gasses to various degrees of success.

Nitric oxide deletions and other effluents have been a pervasive and persistent problem in these electrostatic copying systems. The embodiments of this invention are simple and effective ways to minimize these problems.

Charging devices historically come in three forms; corotrons, scorotrons and dicorotrons; all will be referred to in this disclosure as "corotrons" or a source of "corona" discharge. The charging devices use high voltages to create a corona. This corona can be thought of as a collection of ions (charged atoms or molecules) in a local area. In most cases, the corona is influenced to move towards the desired target by the opposite charge on a screen or grid-type device.

The different names of the charge device or corotrons denote different configurations. Corotrons are simply bare wires. A high DC potential is placed on the corotron to create the corona. To charge photoreceptors to a positive voltage, a large positive DC voltage is placed on the corotron wire. To charge negatively, a negative potential is placed on the wire. Dicorotrons are a wire device also. In this case, the wire is coated with a thick film of dielectric glass. Dicorotrons have an alternating voltage placed on them to create both positive and negative ions. A screen or shield with a DC bias directs the dicorotron's charge toward the photoreceptor. The grid or shield voltage determines the polarity and amplitude of the charge placed on the photoreceptor.

An important consideration is that there are many ways to charge photoreceptors. Some ways have a propensity for problems to occur while others have less of an issue. In relation to nitric oxide deletions, the AC devices (dicorotrons) and the negative DC devices have a higher probability of deletion problems.

As stated, the charge device is the originator of the nitric oxide parking deletion (or, for sake of clarity, deletion). The deletion process begins with the production of corona in normal atmosphere. Corona is a "cloud" of charged ions. Different types of corona contain different ions, $H^+$ and $N_4^+$ are the major positive ions for both AC and DC devices. The negative ions $NO_3^-$ and $O_3^-$ (ozone) are the major ions in negative DC discharge and AC with airflow. AC devices (dicorotrons) also contain the following negative ions: $O^-$, $OH^-$, $O_2^-$, $NO_2^-$, $CO_3^-$.

The ozone ($O_3$) and $NO_x$ (NO and $NO_2$) occur in relatively large amounts. These compounds are also very reactive, chemically. $NO_x$ is known as Oxides of Nitrogen. While both gasses and morpholine can contribute to the deletion problem, $NO_x$ has been cited as the main culprit, hence the reference to Nitric Oxide Deletion.

Recent experiments show that the $NO_x$ output from a dicorotron operated at nominal voltage is entirely $NO_2$. Charge device $NO_2$ output is attributed to the presence of ozone in the charge device area. Ozone oxidizes NO to $NO_2$.

The oxidation of NO to $NO_2$ produces one photon of light at about 1200 nm. This occurs in about 20% of the oxidized $NO_2$. As the molecule decays to a stable state, a photon is emitted with the peak excitation of 1200 nm. This is the basis for a Chemilumenesence Nitric Oxide detector sometimes used in the present embodiments to measure effluents.

Photoreceptors have been shown to be very sensitive to nitric acid-type compounds ($HNO_3$ and $HNO_2$). The nitric acid attacks certain molecules in the transport layer of the photoreceptor rendering them too conductive. This conductivity allows any developed charge on the photoreceptor to leak to ground in the area of the attack or spread in what is sometimes (mistakenly) called lateral charge migration. Lateral charge migration is a separate issue involving the deposit of conductive salts on the photoreceptor through the interaction of corona and atmospheric contaminants, such as morpholine. In Nitric Oxide deletions, in the worst cases, areas near the acid attack appear blank on a copy because toner is not developed to the photoreceptor in those areas. In lesser extent cases, the problem manifests itself as a blurring of the image. Some volatile organic compounds, such as morpholine and organic nitrates are effluents also detrimental to the photoreceptor.

Nitric oxide deletions are often termed parking deletions. This nomenclature arises from the way in which nitric oxide deletions are most prevalent. When charging devices are run for a long period of time (during a long print run) a relatively large amount of $NO_x$ and $O_3$ (as above indicated, collectively known as effluents) are built up. The effluents become adsorbed on the surface of nearby solids. When the machine is shut down, the photoreceptor stops rotation and becomes "parked" with a small area directly adjacent to the charge device. Over a short period of time, the adsorbed effluents are released from the charge device in a process known as outgassing. Since the photoreceptor is parked in very close proximity to the charge device, a small local area of the photoreceptor becomes damaged.

The embodiments of the present invention provide strategies employed to combat and minimize these deletions.

It is known to use Titanium to help chemically reduce effluents around a photoreceptor. (By virtue of its native oxide surface layer). It is also known to use Titanium Dioxide ($TiO_2$) to remove nitric oxides from the environment via titanium dioxide coatings. See articles "Reactive Oxygen Species inhibited by Titanium Dioxide Coatings" (Suzuki et al.)) R. Suzuki, J. Muyco, J. McKittrick, J. McKitrick, J. Frangos. J. Biomed. Mater. Res. A, 2003, Aug. 1 vol. 66 No. 2: pg. 396-402), and "Titanium Dioxide: Environmental White Knight", L. Frazer Environmental Health Perspectives Vol. 109, No. 4, April 2001. It is important to make the distinction between the metal Titanium and the ceramic titanium dioxide. Neither Suzuki nor Frazer suggests use of their process on electrostatic marking system nor suggest the problems of effluents in said systems. Suzuki et. al does not use a thermal plasma spray process; therefore, only provides a titanium coating of from 100-200 nanometers thick. Suzuki's thin coating of elemental titanium was produced by a process that would take an inordinate amount of time (days) to build a coating, as in the present embodiments, of about 20-100 microns and his process must be done in a vacuum. L. Frazer's article does suggest the use of a thermal plasma spray; his process is incapable of producing a coating of $TiO_2$ that is relatively thick (at least 20 microns) and has a porosity of at least 1% of the coating. Also, a pore size of 0.1 micron would be difficult with Frazer's process. An important process difference between the present invention and the process of Frazer is that this invention uses UV energy supplied by the dicorotron as the photo source in the photocatalytic reaction, Frazer uses the UV energy from the sun.

Prior art attempts involved depositing elemental Titanium onto aluminum using physical vapor deposition (PVD) and chemical vapor deposition (CVD) methods such as RF plasma deposition. The titanium metal would then form a native oxide layer by exposure to ambient environment. Unfortunately, these coatings were too thin and were quickly destroyed by the aggressive corona environment. Coatings made by this method are typically 100-200 nm thick. Titanium sheet metal was also tried. Using titanium sheet metal to control effluents was very costly and it was difficult to form titanium sheet metal into the complex shapes required. Methods for the deposition of titanium dioxide ceramic exist (such as sol-gel deposition), but are either considered too expensive or unreliable. Further, the sintering temperatures of titanium dioxide ceramic are too high to allow the material to be directly formed on aluminum. Plasma spray is the most effective alternative when one wishes to place a ceramic coating, such as titanium dioxide on a metal substrate, such as aluminum.

SUMMARY

The embodiments of the present invention provide a process and apparatus whereby an aluminum corona housing is at least partially thermally sprayed by a plasma spray method, this plasma spray raises the electrical conductivity of the $TiO_2$ coating and makes it far more effective in reducing effluents. Generally, ceramics like $TiO_2$ are non-conductive. However, in the present embodiments, reduction of $TiO_2$ in the plasma renders the $TiO_2$ electrically conductive. In the plasma, a structure is formed creating a coating with holes. These holes allow for the movement of electrons which create electronic conduction. Plasma spray is the only known practical method of applying a thick layer of $TiO_2$ to aluminum. The purity of $TiO_2$ used in the present embodiments is at least 99% pure. Any suitable ceramic mixtures containing $TiO_2$ may be used, if desirable. In embodiments, pure titanium dioxide or titanium dioxide having from about 99 percent to about 100 percent by weight titanium dioxide, is used. This plasma spray is described as follows:

Plasma spray coating technology is known and described in, for example, "Plasma-spray Coating", Scientific American, September 1988, pp. 112-117. In a plasma spray procedure, a heat source converts metallic and ceramic materials into a molten spray which is then deposited on a prepared substrate (in this case the corona housing) to form a porous coating. Plasma is a partially-ionized gas containing ions, electrons, free radicals and various neutral species at many different excitement levels. Plasma is created by dissociation and ionization of atomic species. Recombination gives off energy such as heat.

In plasma spray, gases include at least two primary purposes: (1) add heat/energy for material melting; (2) propel molten material to substrate.

A plasma spray gun is a water-cooled device containing an anode and a cathode across which an electric arc is struck. As the gasses pass through this arc, a plasma is formed. With an internal working temperature of about 10,000 degrees centigrade, high-refractory materials such as $TiO_2$ ceramics melt and are propelled to the substrate by gas velocities. Adhesion to the substrate corona housing is primarily through mechanical bonding of the coating, the molten material forms splats on the substrate housing. Grit blasting of the corona housing with aluminum oxide or glass beads improves adhesion of the coating to the substrate by increasing the roughness of the substrate. The porosity of the coating is substantially high, there may be some unmelts which are ceramic particles which did not melt due to unoptimized spray parameters. These unmelts do not adversely affect the intended function of the $TiO_2$ coating.

In exemplary embodiments, a bond coat can be applied on the corona housing to enhance adhesion of the coating on the corona housing. The bond coat can also increase the resistance of the coating to cracking or other defects during cooling after the coating process of the coating. The bond coat can comprise any suitable material, such as a mixture of chrome-aluminum-yttrium-cobalt, or a mixture of nickel-aluminum powder.

The cooling rate of the coating can be controlled to reduce the thermal differential between the corona housing and the coating, to thereby reduce the generation of thermal stresses in the coating. Cooling can be controlled by directing a gas flow onto the corona housing during the coating process. In addition, the corona housing can be preheated to a suitable temperature to reduce the thermal differential between the corona housing and the coating. Preheating the corona housing also promotes the adhesion of the coating. Typically, the temperature of the corona housing and the coating are maintained below about 300 degrees F. to achieve a suitable thermal differential and good coating adhesion.

This plasma sprayed coating on the corona housing offers several substantial advantages over known systems. It is very desirable to have this coating at least on the inside of the U-shaped housing. First, a plasma sprayed coating can be made relatively thick in comparison to the thin prior art coatings that degraded easily in an aggressive corona charging environment. Secondly, $TiO_2$ coatings are hard and substantially chemically inert. This prevents damage and makes the coating impervious to effluent attack. Third, plasma sprayed ceramics such as $TiO_2$ have a natural porosity that makes them well suited to capturing chemical effluents. A highly porous $TiO_2$ coating provides a much larger surface area exposed to the effluents ozone and $NO_x$ for reaction to take place.

The plasma spray raises the electrical conductivity of $TiO_2$ by 12-16 orders of magnitude from normal $TiO_2$ compositions. This is important because dicorotron housings must be substantially electrically conductive for proper function of corona generation. The coatings of $TiO_2$ must, therefore, be hard, highly porous and impervious to attack by the effluents. Coatings of $TiO_2$ of from 10-200 microns thick have shown very desirable results. Large pore sizes of at least 0.1 microns also showed good results as did a coating of at least 1% porosity.

Several tests conducted using $TiO_2$ coatings on a corotron aluminum housing compared to uncoated aluminum housings showed that there was no statistically significant difference in charging performance of the coated and non-coated corotrons.

To summarize, a by-product of corona charging devices are several gasses (mostly notably $NO_x$ (nitrogen and oxygen compounds or impurities) and Ozone) and morpholine, which are referred to as "effluents" which can negatively affect the photoreceptor and resulting copies. The present embodiments prevent or substantially minimize deletions by introducing a thick and porous $TiO_2$ coatings on at least part of the corona housing by a plasma spray.

This plasma spray provides a thicker much more porous and larger surface area coating of $TiO_2$ than previously used; therefore, a much more effective means to reduce effluents.

DETAILED DESCRIPTION OF DRAWINGS AND PREFERRED EMBODIMENTS

Figure 1:
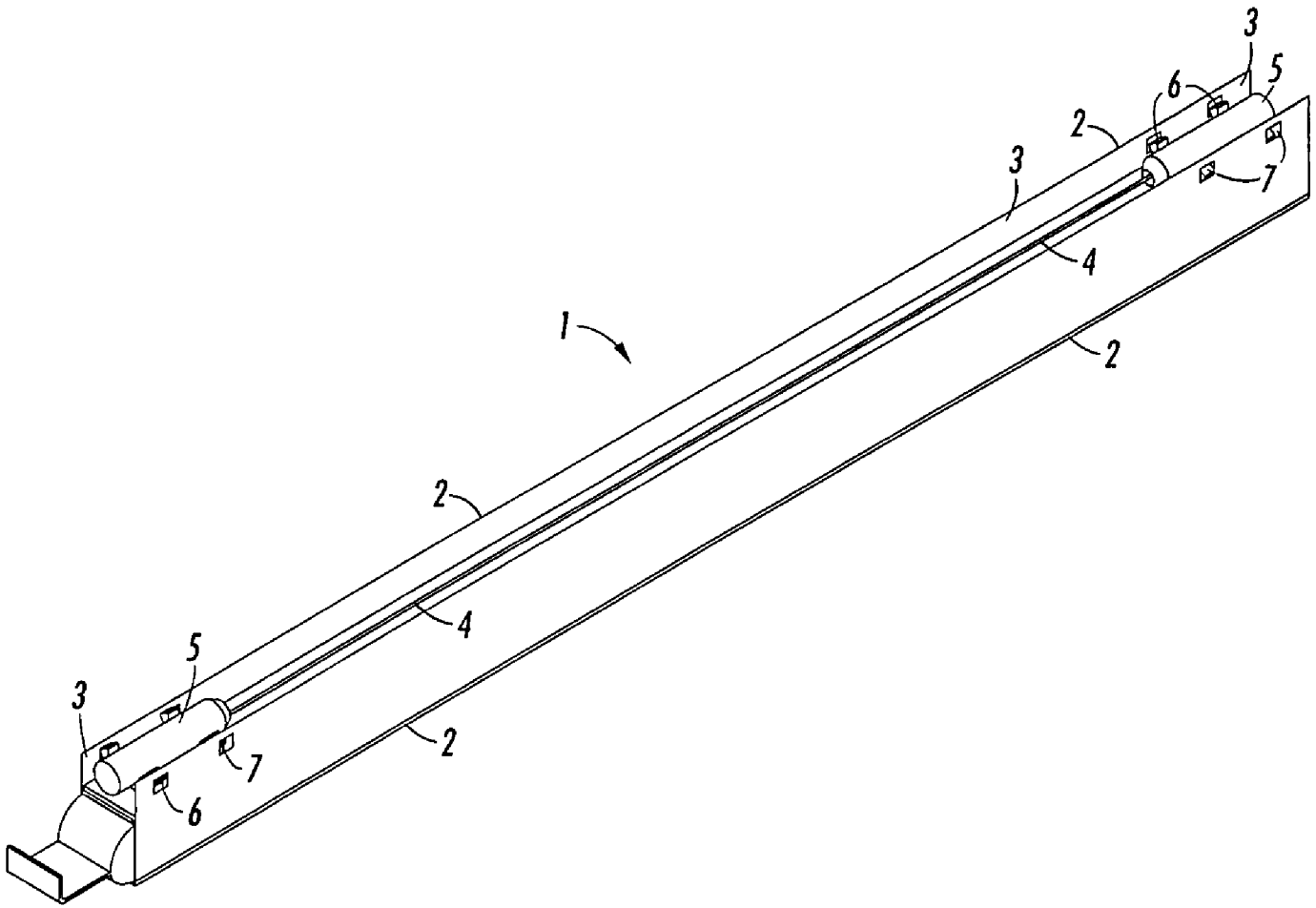
FIG. 1 illustrates a top perspective view of an uncoated corotron unit of the prior art.

In FIG. 1, a prior art dicorotron (corona) unit 1 is shown having a dicorotron housing 2 which is an elongated u-shaped housing. Inside this housing is a wire assembly made up of a wire electrode 4 attached at each end to anchors 5. Anchors 5 are removably attached to the housing 2 by grippers 6 that snap into housing apertures 7. In this embodiment, the open face 3 of the dicorotron unit 1 will be when in use, adjacent the photoreceptor to be charged by wire electrode(s) 4.

Figure 2:
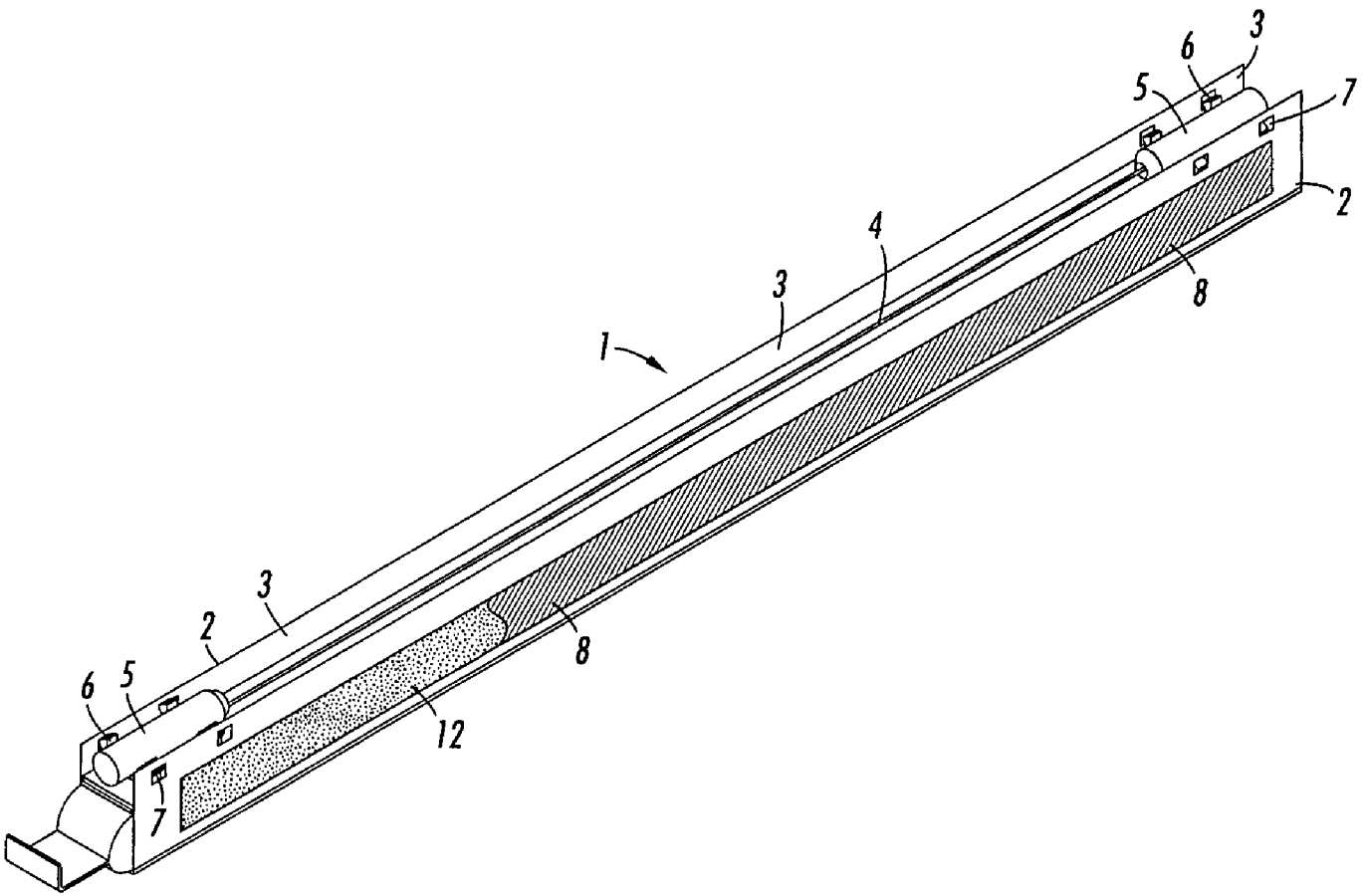
FIG. 2 illustrates a top perspective view of a present embodiment $TiO_2$ coated corotron housing.

In FIG. 2, the dicorotron unit 1 of FIG. 1 is plasma sprayed coated with a porous $TiO_2$ coating 8. This coating 8 may be on any portion(s) of housing 2, FIG. 2 shows this coating 8 on an outside portion of housing 2 for clarity only. Coatings 8 on the interior of the housings are beneficial in that the coating 8 is closer to the wire electrode 4, which causes the effluents to be formed. While the interior coating is more effective, the coating 8 may be wherever it is suitable. The $TiO_2$ coating 8 should be at least 10-200 microns thick, but thicknesses exceeding 200 microns will function depending upon the various conditions present. A coating of 20-40 microns functioned desirably in one embodiment. The porosity of coating 8 should be at least 1% of the coating, and the pore size should be at least 0.1 microns. In FIG. 2 a bond coat 12 is applied to enhance adhesion of the $TiO_2$ coating 8 on the housing 2. This bond coat 12 also increases the resistance of the $TiO_2$ coating 8 to cracking during the cooling after the coating process. The bond coat 12 can comprise any suitable material, including chrome, aluminum alloys, yttrium, cobalt, nickel-aluminum or mixtures thereof.

Figure 3:
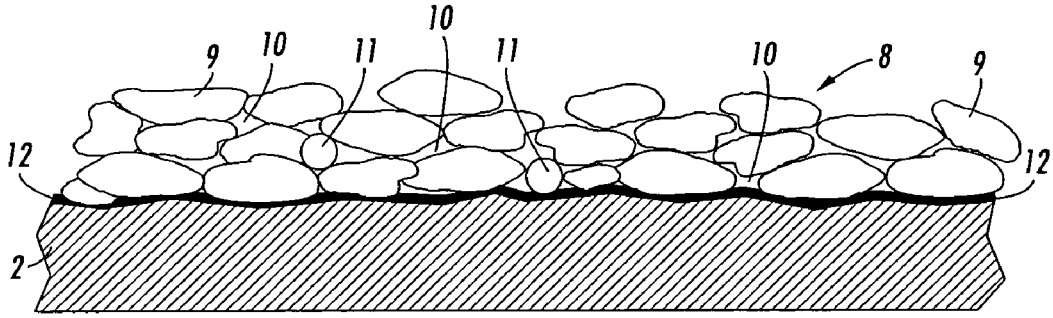
FIG. 3 illustrates a cross sectional view of the porous $TiO_2$ coating and bond coat on the corona housing substrate.

In FIG. 3 a close-up view of $TiO_2$ coating 8 and bond coat 12 is illustrated. The substrate-housing 2 has a plasma spray coating 8 made up of $TiO_2$. In this coating 8 there are $TiO_2$ particles 9, pores 10 and some unmelts 11. The pores 10 are at least 1% of this coating 8 and perform the desired function of collecting and neutralizing effluents given off by the corona discharge. This protects the photoreceptor and the quality of subsequent copies produced. Adhesion to housing 2 of coating 8 is primary through mechanical bonding of the molten material and adhesion is substantially enhanced by bond coat 12, above noted. The bond coat 12 also minimizes cracking of the $TiO_2$ coating 8 and prolongs the life of coating 8. The unmelts 11 are particles which did not melt due to un-optimized spray parameters, but they do not adversely affect the function of the coating 8, provided the necessary thickness and porosity above discussed is present.

In summary, an embodiment of this corona charging device is useful in an electrostatic marking system and comprises, in an operative arrangement, an aluminum housing, at least one corona generating wire electrode positioned within said housing and a substantially porous $TiO_2$ coating on at least one portion of the housing. A bond coat is placed on the aluminum housing prior to coating the housing with $TiO_2$. The wire electrode is enabled to deposit an electrical charge on a photoreceptor surface used in the marking system. The porous coating is enabled to capture, reduce and neutralize amounts of any effluents created by the corona generating electrode that are located in an environment of the corona charging electrode, the corona charging device and the photoreceptor. The porous coating is a thermally plasma sprayed $TiO_2$ coating which has a thickness of at least from 20-40 microns and a pore size of at least 0.1 microns.

The $TiO_2$ coating being thermal-plasma sprayed coating provides sufficient porosity and conductivity to the $TiO_2$ to substantially increase its ability to remove effluents from the area around the corona charging device, the photoreceptor and other parts of the system. Other thermal sprays that accomplish the same result as plasma sprays are included within the scope of this invention. Such sprays include High Velocity Oxygen Fuel (HVOF) processes. However, plasma spray is the preferred thermal spray since it is proved to consistently produce the most effective and desirably thick and porous $TiO_2$ coatings.

The preferred and optimally preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A corona charging device comprising in an operative arrangement a metallic housing, at least one corona generating electrode and a porous $TiO_2$ coating on at least a portion of said housing, at least a portion of said electrode positioned within and supported by said housing, said porous coating having a sufficient porosity and conductivity to substantially increase said coatings' ability to capture and reduce amounts of any effluents created by said corona generating electrode, said porous coating being a plasma sprayed coating.

2. The device of claim 1 wherein said coating is at least 20 microns thick.

3. The device of claim 1 wherein said coating has at least a porosity equal to about 1% of total coating.

4. The device of claim 1 wherein pores in said porous coating have a pore size of at least 0.1 microns.

5. The device of claim 1 wherein said effluents include effluents selected from the group consisting of morpholine, ozone, NOx and mixtures thereof and wherein said x of said NOx has a value of from 1 or 2.

6. The device of claim 1 wherein said plasma sprayed coating is enabled to raise the electrical conductivity of said $TiO_2$ from 12-16 orders of magnitude from a normal substantially pure $TiO_2$ composition.

7. The device of claim 1 wherein said plasma sprayed coating is substantially impervious to chemical attack by said effluents.

8. The device of claim 1 wherein said coating is about from 10-200 microns thick.

9. A corona charging device useful in an electrostatic marking system comprising in an operative arrangement a metallic housing, at least one corona generating electrode positioned within said housing, a bond coat and a porous $TiO_2$ coating on at least a portion of said metallic housing, said bond coat enabled to enhance adhesion of said $TiO_2$ coating on said metallic housing, said electrode enabled to deposit an electrical charge on a photoreceptor surface used in said marking system, said porous coating enabled to capture and neutralize amounts of any effluents created by said corona generating electrode that are located in an environment of said corona generating electrode and said photoreceptor, said porous coating being a thermally plasma sprayed coating which enables said coating to have an increased ability to reduce and neutralize said effluents present during or after a charging step.

10. The device of claim 9 wherein said coating is at least 20 microns thick.

11. The device of claim 9 wherein said coating has at least a porosity equal to about 1% of said total coating.

12. The device of claim 9 wherein pores in said porous coating have a pore size of at least about 0.1 microns.

13. The device of claim 9 wherein said effluents include effluents selected from the group consisting of morpholine, ozone, $NO_x$ and mixtures thereof and wherein said X of said $NO_x$ has a value of 1 or 2.

14. The device of claim 9 wherein said plasma sprayed coating is enabled to raise the electrical conductivity of said $TiO_2$ from 12-16 orders of magnitude of the conductivity of a normal $TiO_2$ composition.

15. The device of claim 9 wherein said plasma sprayed coating is substantially impervious to chemical attack by said effluents and said bond coat includes a material selected from the group consisting of chrome, aluminum, yttrium, cobalt, nickel, and mixtures thereof.

16. A corona charging device useful in an electrostatic marking system, said device comprising in an operative arrangement a u-shaped aluminum housing, at least one corona generating electrode positioned within said housing, a bond coat, and a substantially porous $TiO_2$ coating on at least an inside portion of said housing, said bond coat positioned between said housing and said $TiO_2$ adhesion to said housing and also adapted to increase said $TiO_2$ coatings' resistance to cracking and defects, said corona generating electrode enabled to deposit an electrical charge on a photoreceptor surface used in said marking system, said porous coating enabled to capture, reduce and neutralize amounts of any effluents created by said corona generating electrode that are located in an environment of said corona generating electrode, said corona charging device and said photoreceptor, said porous coating being a thermally plasma sprayed coating having a thickness of from 20-40 microns and a pore size of at least 0.1 microns.

17. The device of claim 16 wherein said coating has a porosity greater than about 1% of the total coating.

18. The device of claim 16 wherein said coating is enabled to reduce the amount of effluents selected from the group consisting of morpholine, ozone, nitrogen-oxygen compounds and mixtures thereof.

19. The device of claim 16 wherein said plasma sprayed coating is enabled to raise an electrical conductivity of a normal $TiO_2$ composition from 12-16 orders of magnitude, thereby providing a $TiO_2$ coating having a substantially increased electrical conductivity.

20. The device of claim 16 wherein said plasma sprayed coating is substantially impervious to chemical attack by said effluents.

* * * * *